US005354463A

United States Patent [19]

Turunen et al.

[11] Patent Number: 5,354,463

[45] Date of Patent: Oct. 11, 1994

[54] DIELECTRIC FILTER

[75] Inventors: Aimo Turunen; Pauli Näppä; Tapio Takalo, all of Oulu, Finland

[73] Assignee: LK Products OY, Kempele, Finland

[21] Appl. No.: 904,403

[22] Filed: Jun. 25, 1992

[30] Foreign Application Priority Data

Jun. 25, 1991 [FI] Finland ..... 913082

[51] Int. Cl.[5] ..... H01P 1/202

[52] U.S. Cl. ..... 210/232; 333/206

[58] Field of Search ..... 333/202, 206, 222; 210/504, 496, 510.1, 500.26, 232

[56] References Cited

U.S. PATENT DOCUMENTS

| | | |
|---|---|---|
| 4,028,652 | 6/1977 | Wakino et al. . |
| 4,255,729 | 3/1981 | Fukasawa et al. . |
| 4,431,977 | 2/1984 | Sokola et al. . |
| 4,559,508 | 12/1985 | Nishikawa et al. . |
| 4,692,726 | 9/1987 | Green et al. . |
| 4,703,291 | 10/1987 | Nishikawa et al. . |
| 4,716,391 | 12/1987 | Moutrie et al. . |
| 4,737,746 | 4/1988 | Ueno . |
| 4,740,765 | 4/1988 | Ishikawa et al. . |
| 4,800,347 | 1/1989 | Yorita et al. . |
| 4,800,348 | 1/1989 | Rosar et al. . |
| 4,821,006 | 4/1989 | Ishikawa et al. . |
| 4,829,274 | 5/1989 | Green et al. . |
| 4,954,796 | 9/1990 | Green et al. . |
| 5,010,309 | 4/1991 | Manssene t al. ..... 333/206 |
| 5,103,197 | 4/1992 | Turunen et al. . |

FOREIGN PATENT DOCUMENTS

| | | |
|---|---|---|
| 0208424 | 1/1987 | European Pat. Off. . |
| 0401839 | 12/1990 | European Pat. Off. . |
| 114503 | 7/1983 | Japan . |
| 101902 | 5/1984 | Japan . |
| 161806 | 7/1986 | Japan . |
| 312701 | 12/1988 | Japan . |
| 94901 | 4/1990 | Japan . |
| 2184608 | 6/1987 | United Kingdom . |
| 2234398 | 1/1991 | United Kingdom . |
| 2234399 | 1/1991 | United Kingdom . |
| 2236432 | 4/1991 | United Kingdom . |

OTHER PUBLICATIONS

Patent Abstracts of Japan, vol. 12, No. 127 (E-602)(2974), Apr. 20, 1988 & JP-A-62 252 202 (Fuji Electrochem Co., Ltd.), Nov. 4, 1989.

Patent Abstracts of Japan, vol. 11, No. 312 (E-548)(2759) Oct. 12, 1987 & JP-A-62 104 201 (Fujitsu Ltd.), May 14, 1987.

Patent Abstracts of Japan—vol. 7, No. 292(E-219)(1437) Dec. 27, 1983 & JP-A-58-168 302 (Fujistu K.K.) Oct. 4, 1983.

Patent Abstracts of Japan—vol. 5, No. 11(E-42)(683) Jan. 23, 1981 & JP-A-55 141 802 (Alps Denki K.K.) Nov. 6, 1980.

Patent Abstracts of Japan—vol. 12, No. 106(E-596)(2953) Apr. 6, 1988 & JP-A-62 235 801 (Fuji Electrochem Co., Ltd.) Oct. 16, 1987.

*Primary Examiner*—Frank Spear

*Attorney, Agent, or Firm*—Darby & Darby

[57] ABSTRACT

The body of a dielectric filter is provided with at least two parallel flanges (6) on either side of a side surface (4) having electrode patterns thereon, which project from the plane of the patterned side surface (4). The filter (1) is fastened, with the patterned side surface (4) facing downwards, to a base (9), for example a circuit board, which has, at least on one side, over an area the size of the filter, a conductive material which is in electrical contact with the coated surfaces of the filter. The filter is thus enveloped by a conductive layer on substantially all its sides.

11 Claims, 1 Drawing Sheet

DIELECTRIC FILTER

The invention relates to a dielectric filter which comprises a body of a dielectric material having upper and lower surfaces, two side surfaces, two end surfaces and at least one hole which extends from the upper surface to the lower surface, and an electrically conductive layer covering major portions of the lower surface, one side surface, both end surfaces and the surface of said hole thereby forming a transmission line resonator, the uncoated side surface having an electrode pattern thereon for providing electrical signal coupling to and from the transmission line resonator.

Finally, at least the patterned surface is covered with a cover made of a conductive material, whereupon the dielectric filter is enveloped by a conductive layer substantially throughout. A filter of this type is described in European Patent Application EP-A-0401839 and corresponding U.S. Pat. No. 5103197.

The dimensioning of the cover and forming it to the correct size and shape constitutes a precise and time-consuming work step, and the manufacturing of the cover is a cost-increasing factor. Furthermore, the mechanical fastening of the dimensioned cover to the ceramic block is cumbersome and slow. The final step of manufacture of a ceramic filter thus substantially increases the cost of manufacture of the filter.

According to the present invention, there is provided a filter comprising a body of dielectric material having an upper surface, a lower surface, two side surfaces, two end surfaces and at least one hole which extends from the upper surface to the lower surface and an electrically conductive layer covering major portions of the lower surface, one side surface, both end surfaces and the surface of said hole thereby forming a transmission line resonator, the uncoated side surface having an electrode pattern thereon for providing electrical signal coupling to and from the transmission line resonator characterized in that the two opposing end surfaces extend beyond the patterned side surface to provide first and second parallel flanges enclosing the patterned side surface on two sides for mounting said filter on a substrate such that the substrate is substantially parallel to and spaced from the patterned side surface. This has the advantage that the expensive final step of manufacturing and filtering a formed cover is eliminated. This reduces the manufacturing costs as this slow manufacturing step is eliminated and there is the saving on the cost of manufacturing the cover as no cover for the patterned side surface is required since this is provided by the base to which the filter is fastened.

The invention will now be described, by way of example only, with reference to the accompanying drawings, of which:

Figure 1:
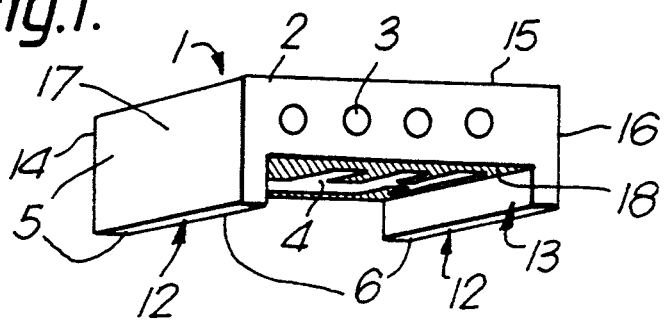
FIG. 1 shows a first embodiment of a filter body of the invention.

As with the known filters described above, a filter 1 according to the invention comprises a body of dielectric material e.g. a ceramic material which has parallel holes 3 extending from an upper surface 2 to a lower surface 14 so as to constitute transmission-line resonators. All of the surfaces of the body including the holes 3, with the exception of the upper surface 2 and a patterned side surface 4 which has electrode patterns thereon as in the known filter are coated throughout with an electrically conductive material 5. The coated inner surfaces of the holes 3 connect with the coating of the lower surface 14. The coupling from and between the resonators is by means of the electrode patterns 18 formed on the side surface 4 using a mask, these electrode patterns 18 being indicated in FIG. 1 by hatching. The number, shape and properties of the electrode patterns 18 and any discrete components connected thereto vary according to the desired properties of the filters and are of no particular relevance to the present invention and will so not be described here. They are, however, described in EP-A-0401839.

The two opposing end faces (16, 17) of the body extend beyond the patterned side surface 4 to provide two flanges 6 between which is the patterned side surface 4. These flanges 6, which are perpendicular to the patterned side surface 4 and extend to the same distance, are formed at the manufacturing stage of the ceramic block, being thus integral with the body, and an extra manufacturing step is not needed. The flange surface integral with the upper surface is uncoated, but the inner surface 13 may be coated or uncoated. The flange surface 12 parallel to the patterned side surface 4 is coated.

Figure 2:
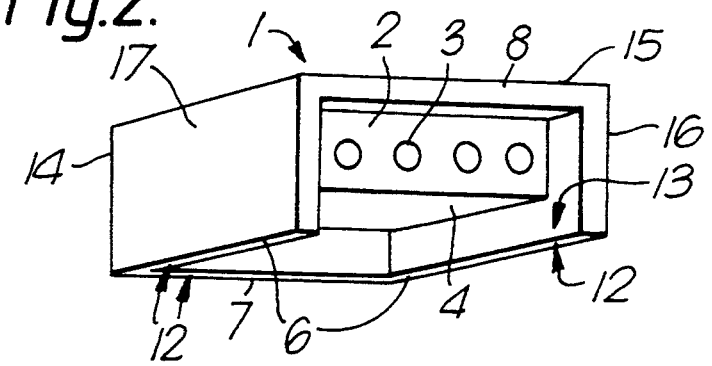
FIG. 2 shows a second embodiment of a filter body of the invention.

In a second embodiment shown in FIG. 2, the lower surface 14 is also extended beyond the patterned side surface 4 to the same distances as the two parallel flanges 6 to provide a third flange 7, which is also perpendicular to the patterned side surface 4 and integral with the body. Additionally, the two parallel flanges 6 extend beyond the upper surface 2 by the same distance so that the upper surface 2 is between the two parallel flanges 6 and the coated side surface opposite the patterned side surface 4 extends beyond the upper surface 2 to the same extent as the two parallel flanges 6 to provide a fourth flange 8. In this embodiment, both the upper surface 2 and the patterned side surface 4 are enclosed on three sides. All of the inner surfaces of these flanges 6 and 8 adjacent the upper surface 2 may be coated with a conductive material, and a cover made of a conductive material can be fastened to the flanges 6 and 8 to cover the upper surface 2. The third flange 7, which extends from the lower surface 14, may also be coated on all sides with a conductive material. The inner surfaces 13 of the flanges 6, 7 and 8 may be left uncoated. When a cover is provided it may additionally have, above the resonators, tongues for regulating the resonance frequency.

Figure 3:
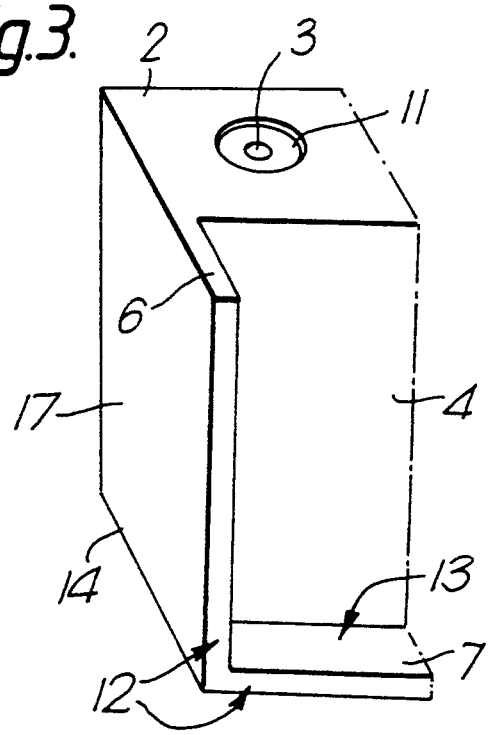
FIG. 3 shows a third embodiment of a filter body of the invention.

In a third embodiment shown in FIG. 3, the holes 3 are located in cylindrical recesses 11. The surfaces of the recesses 11 are uncoated, so that the recesses form an air clearance above the resonators when the upper surface 2 is provided with a cover made of a conductive material, which cover may have, above the resonators, tongues by the bending of which the resonance frequency can be regulated.

Figure 4:
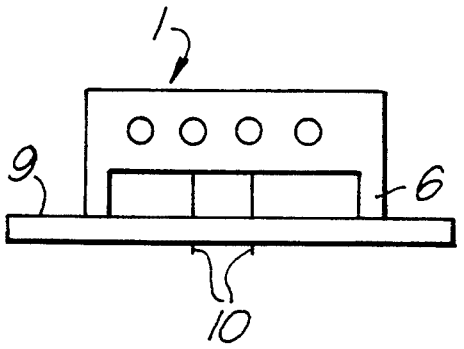
FIG. 4 shows a filter body fastened to a substrate.

The completed filter of any of the three embodiments is fastened, as shown in FIG. 4, with the patterned side surface 4 downwards, to a base 9, for example a circuit board or a metal sheet, which has, at least on one side, a conductive material over an area the size of the filter, this material being in electrical contact with the coated surfaces of the filter 1. Thus the filter is enveloped by a conductive layer on substantially all sides. The fastening of the filter 1 to the base 9 is carried out so that signal conductor pins 10 for connection to the patterned side surface 4 enter via holes in the base so that they are insulated from the conductive layer of the base, and thereafter the first, second and third flanges 6 and 7 are soldered to the base 9 by the electrically conductive coating.

If there is no third flange 7 at the end of the lower edge of the patterned side, the opening left below the lower surface can be covered with a cover made of a conductive material. If the opening is not covered, the filter should be placed sufficiently far from other nearby components so that they will not cause interference in the operation of the dielectric filter.

The upper surface 2 of any of the three embodiments may also be provided with a cover of a conductive material (not shown). The cover may be provided with tongues located above the resonator holes 3 which can be bent to tune the resonator to the required resonator frequency. The provision of such tongues is well known in filter technology. If no cover is provided, the filter should be placed sufficiently far from other components to avoid interference which will effect the operation of the filter.

Instead of conductor pins 10, the wiring can be implemented by bringing from the surface 4 conductors as conductor strips via the inner surface 13 of first, second and third flanges 6 or 7 to the flange surface 12 which will lie on the base, whereupon they can be soldered to the conductor spots (not shown) on the base.

It will be evident to a person skilled in the art, from the foregoing description, that variations are possible within the scope of the present invention.

We claim:

1. A filter (1) comprising a body of dielectric material having an upper surface (2), a lower surface (14), two side surfaces (4, 15), two end surfaces (16, 17) and at least one hole (3) which extends from the upper surface to the lower surface and an electrically conductive layer (5) covering major portions of the lower surface; one side surface, both end surfaces and the surface of said hole thereby forming a transmission line resonator, the uncoated side surface extending in a plane and having an electrode pattern (18) thereon for providing electrical signal coupling to and from the transmission line resonator, first and second parallel flanges (6) extending from the two opposing end surfaces and extending beyond the patterned side surface so as to bound the patterned side surface on two sides, said flanges each having multiple flange surfaces with one side flange surface (12) arranged for mounting said filter on a substrate (9) such that the patterned side surface spaces away from the substrate, each of the one side flange surfaces extending in a plane parallel to that of the plane of the patterned side surface and being coated with an electrically conductive material.

2. A filter according to claim 1, wherein the lower surface extends beyond the patterned side surface by the same distance as the first and second parallel flanges (6) to provide a third flange (7) such that the patterned side surface is enclosed on three sides by said first, second and third flanges.

3. A filter according to claim 1 or claim 2 wherein the coated side surface extends beyond the upper surface to provide a fourth flange (8) and the first and second parallel flanges extend in a plane perpendicular to the patterned side surface beyond the upper surface by the same distance as the fourth flange such that the upper surface is enclosed on three sides by said first, second and fourth flanges.

4. A filter according to claim 1 wherein the hole is located within an uncoated recess (11) in the upper surface.

5. A filter according to any claims 1, 2 or 4 wherein the flanges are formed integrally in said body.

6. A filter according to any claim 1, 2 or 4 wherein the upper surface of the dielectric body is provided with a conductive cover.

7. A filter according to any of claims 1, 2 or 4 wherein the lower surface of the dielectric body is provided with a conductive cover.

8. A filter assembly comprising a filter according to any of claims 1, 2 or 4, the substrate having a surface coated, over an area the size of a face of the filter, with an electrically conductive material, the conductive area being in electrical contact with the conductive surfaces of the filter such that the filter is substantially enclosed by a conductive layer.

9. An assembly according to claim 8 wherein the patterned side surface of the dielectric body is provided with conductor pins (10) for coupling electrical signal to said electrode pattern, the conductor pins being fed through holes in the substrate.

10. An assembly according to claim 9 wherein the substrate is a circuit board and patterned side surface has conductor strips connected thereto for coupling electrical signals to the electrode pattern, the conductor strips being coupled to conductor spots provided on the substrate via an inner surface of the first and second flanges and the first and second flange surfaces which lie on the substrate.

11. A filter according to claim 1, in combination with the substrate, the substrate being adjacent said surface flanges and having a conductive coating, said conductive layer and said conductive coating together enveloping the filter substantially on all sides.

* * * * *